US006799523B1

(12) United States Patent
Cunha

(10) Patent No.: US 6,799,523 B1
(45) Date of Patent: Oct. 5, 2004

(54) PULL-OUT SHELF

(75) Inventor: Pedro Cunha, Hestra (SE)

(73) Assignee: HL-Display AB, Skarpnack (SE)

( * ) Notice: Subject to any disclaimer, the term of this patent is extended or adjusted under 35 U.S.C. 154(b) by 42 days.

(21) Appl. No.: 10/070,639

(22) PCT Filed: Sep. 7, 2000

(86) PCT No.: PCT/SE00/01736

§ 371 (c)(1),
(2), (4) Date: May 13, 2002

(87) PCT Pub. No.: WO01/21040

PCT Pub. Date: Mar. 29, 2001

(30) Foreign Application Priority Data

Sep. 9, 1999 (SE) ..... 9903198

(51) Int. Cl.[7] ..... A47B 9/00
(52) U.S. Cl. ..... 108/108; 108/143
(58) Field of Search ..... 312/408, 333; 108/106, 107, 143, 137, 102, 152; 248/220.42, 220.43, 242, 244, 241; 211/90.02, 175

(56) References Cited

U.S. PATENT DOCUMENTS 2,728,626 A * 12/1955 Gussack ..... 312/333
3,248,079 A * 4/1966 Kennedy ..... 248/242
3,746,418 A * 7/1973 Barber, Jr. ..... 312/334.45
4,378,925 A * 4/1983 Griffin ..... 248/242
4,610,487 A * 9/1986 Delmege et al. ..... 384/18
4,620,489 A * 11/1986 Albano ..... 108/105
4,669,692 A * 6/1987 Mastrodicasa ..... 248/250
4,679,950 A * 7/1987 Delmege et al. ..... 384/18
4,735,470 A * 4/1988 Falk ..... 312/246
4,751,884 A * 6/1988 Ball ..... 108/147

* cited by examiner

*Primary Examiner*—Jose V. Chen
(74) *Attorney, Agent, or Firm*—Sughrue Mion, PLLC

(57) ABSTRACT

Pull-out shelf for mounting on rack uprights, comprising two brackets (4) projecting from the uprights. Each bracket bears a pullout rail (7) and a shelf plane (8–12) or equivalent, supported by the rails, for articles which are to be placed on the shelf. The shelf comprises at least one releasable locking member which, when an associated operating member (18) is acuated manaully, releases the pull-out rails (7), so that these can be pulled out and pushed in, and, in the unactuated state, locks the rails relative to the brackets (4). The locking members are adapted so as, when the operating member is unactuated, to lock the rails under the action of a spring force, the manual actuation of the operating member taking place counter to the action of this spring force. Releasing the operating member then results in instantaneous locking of the rails and thus the shelf in the current position, which allows stepless locking of the shelf in optional positions between an inner and an outer end position.

12 Claims, 8 Drawing Sheets

PULL-OUT SHELF

The present invention relates to a pull-out shelf for mounting on rack uprights or the like and comprising two brackets projecting from the uprights or from supports mounted thereon, at least one rail mounted on each bracket so as to be capable of being pulled out, and a shelf plane or equivalent, supported by the rails, for articles which are to be placed on the shelf, which shelf comprises at least one releasable locking member which, when an associated operating member is actuated manually, releases the pull-out rails, so that these can be pulled out and pushed in, and, in the unactuated state, locks the rails relative to the brackets.

Shelves of this type are used in, inter alia, shops as, in the pulled-out position, they make placing new products on the shelf or rearranging products located on the shelf easier. There are many previously known constructions of pull-out shelves. One example is disclosed in U.S. Pat. No. 4,705,175. However, the shelf according to this patent specification has only two positions in which the shelf is locked, namely a fully pushed-in position and a fully pulled-out position. In addition to the fact that this does not allow any variation in the position of different shelves, there is also a safety risk as the shelves are usually inclined downward somewhat in the forward direction. This means that, after release, a shelf bearing heavy products can come out with very great force if, for example, the person who released the shelf loses his grip. In particular in the case of shelves which are high up, this can give rise to serious accidents.

EP-B1-0,730,424 describes another example of a pull-out shelf. In this case, the shelf can be locked in various positions between an inner and an outer end position. However, the intermediate positions are predetermined by slots or holes and fine adjustment of one shelf relative to another is not possible.

Shelves for shop fittings are not of standardized depth, which means that, if shelves from different manufacturers are to be mounted on a common rack, these may project to varying degrees from the rack. A shelf according to the aforementioned European patent allows only stepwise adjustment and thus cannot with certainty be adapted to other known shelves.

In the known shelf, the supporting brackets are also made with adjustment notches, which means that their bearing capacity is reduced, as a result of which the dimensions have to be increased. This means that the shelves themselves occupy more of the precious space in the shops and are more bulky when it comes to storage and transport. The brackets are already connected to transverse stays during manufacture to form a frame supporting the shelf plane. This means that the shelves will require a relatively great volume during storage and transport.

SUMMARY OF THE INVENTION

One main object of the present invention is to produce a pull-out shelf which art eliminates inter alia the abovementioned problems and allows effective locking of the shelf in an optional position between an inner and an outer end position.

Another object is to produce such a shelf which is adjustable so that it can easily be used together with other shelves of different depth.

A further object is to produce a shelf of the type indicated above, which can be stored and transported in a flat demounted state and can easily be assembled in the shop.

In order to achieve the abovementioned aims, a shelf of the type indicated in the first paragraph is, according to the invention, characterized in that, when the operating member is unactuated, the locking member locks the rails under the action of a spring force, in that said manual actuation of the operating member takes place counter to the action of said spring force, so that releasing said operating member results in instantaneous locking of the rails and thus the shelf in the current position so as to allow stepless locking of the shelf in optional positions between an inner and an outer end position.

As a consequence of the instantaneous locking of the shelf on release of the operating member, inter alia the risk of accidents associated with pulling out a shelf bearing heavy products is eliminated. Moreover, the shelf can be locked in a desired position in relation to another shelf which may be of different depth. As a result of this, it is possible to ensure that the front edge of the shelf comes into line with the front edge of another shelf and that what is known as a cascade formation can also be brought about with shelves of different depth.

The locking member suitably follows the movement of the shelf and comprises a friction body projecting in between two engagement members borne by one bracket of the shelf. By means of this body, it is possible to lock the shelf in the desired position without making use of weakening notches or equivalent in the bracket. The latter can then be made with smaller dimensions than has previously been possible.

The friction body preferably has a non-circular cross section, the operating member being adapted so as, when actuated, to bring about a rotation of the friction body from a locking position, in which it is in friction engagement with said engagement surfaces, into a free position, in which the rail can be displaced in relation to these.

It is preferred that the friction body has a rectangular, preferably square, cross section and that, in the locking position, it is rotated in such a manner relative to the two engagement surfaces that the engagement with these increases as a consequence of an outwardly directed tensile force acting on the shelf.

This embodiment also reduces the risk of accidents as a consequence of heavily laden shelves coming out unintentionally.

Further characteristics of the invention emerge from the patent claims below.

BRIEF DESCRIPTION OF THE DRAWINGS

The invention will be described in greater detail below with reference to the embodiments shown by way of example in the appended drawings, in which.

DETAILED DESCRIPTION OF THE INVENTION

Figure 1:
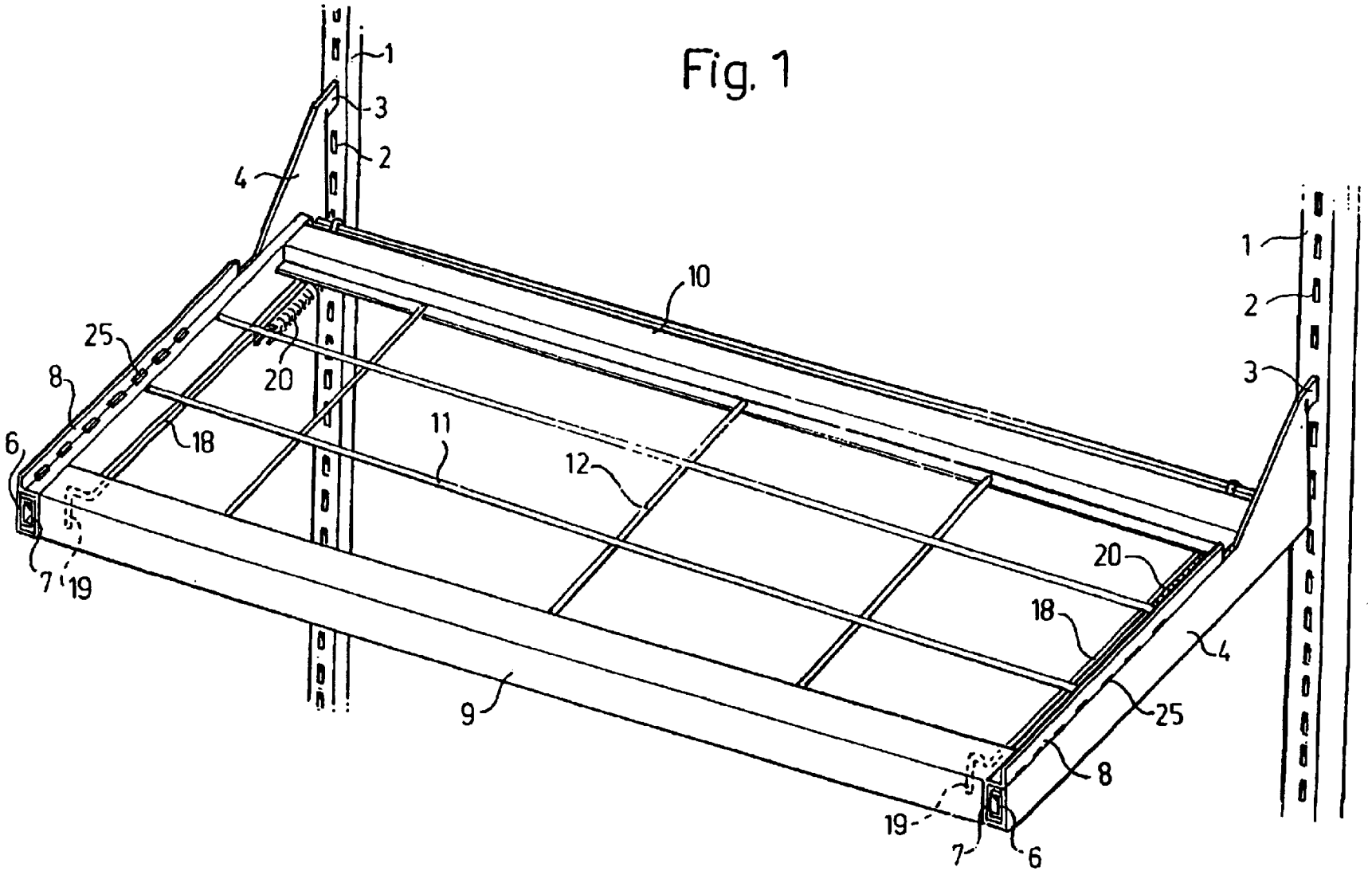
FIG. 1 is a perspective view of an embodiment of a shelf according to the present invention in the pushed-in position.
Figure 2:
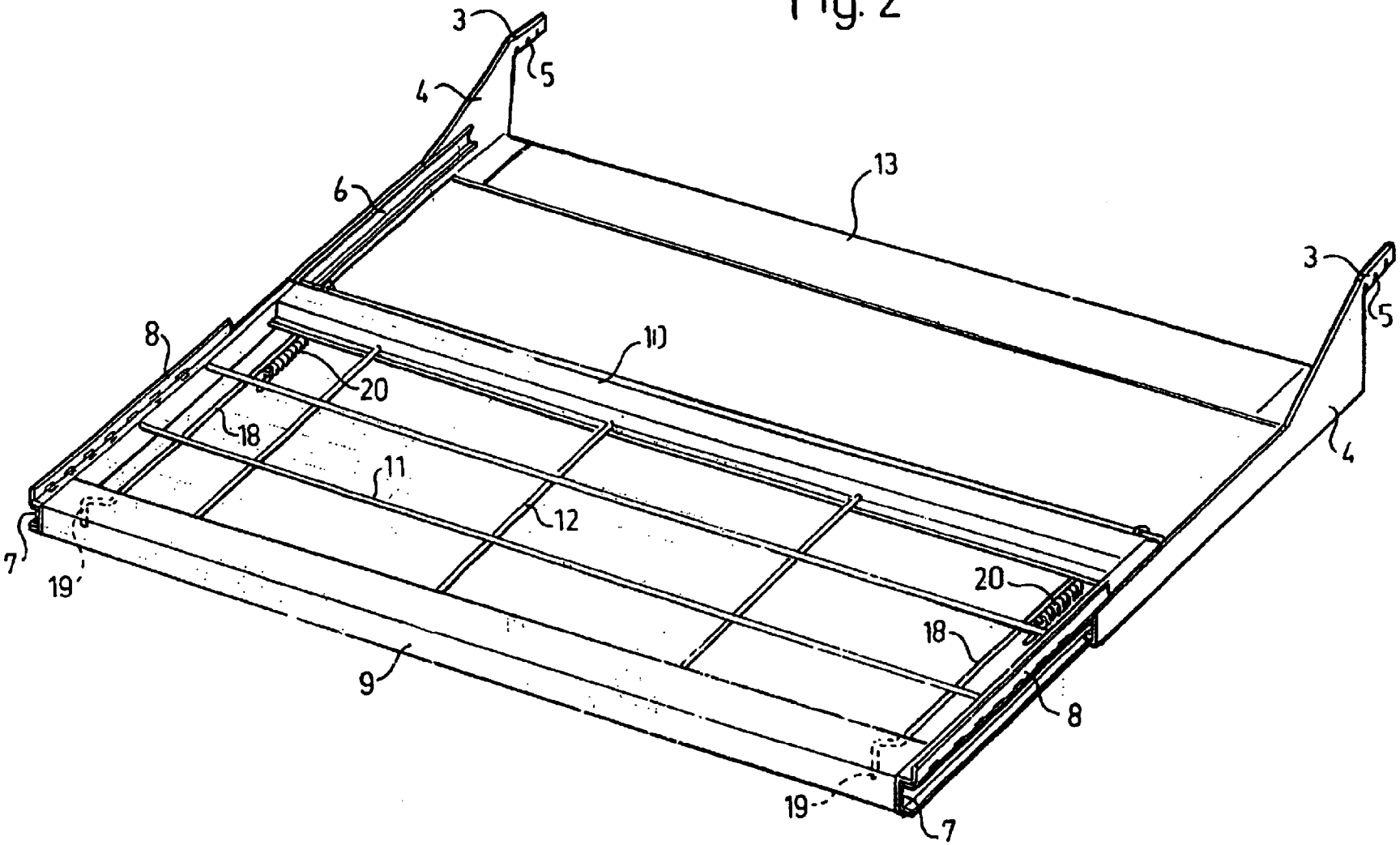
FIG. 2 shows the shelf according to FIG. 1 in the fully pulled-out position.

In FIGS. 1 and 2, reference number 1 indicates two vertical rack uprights of conventional design. The uprights are provided with slot-shaped holes 2, into which rear portions 3 of brackets 4 of a shelf according to the invention can be inserted. The portions 3 are provided with adjustment notches 5 which make it possible for the shelf to be mounted at different angles relative to the vertical uprights 1.

Arranged on the inside of each bracket 4 of the shelf is a fixed rail 6. A pull-out rail 7, on which an angle profile 8 is mounted by means of hook-shaped elements (not shown), slides in the fixed rail 6. The pull-out rail 7 can be in the form of two rails which are telescopically displaceable in one another. At the front and the rear edges of the shelf, the angle profiles 8 are interconnected by means of transverse members 9 and 10, respectively. Resting on these in this case is a net-like support plane 11, 12 which forms a support for the desired support surface for the products which are to be placed on the shelf. For example, shelf dividers can be mounted on the rods 12 running between the members 9 and 10, and spring operated product feeders can be arranged in the product compartments formed by the dividers. This has not been shown and does not constitute a part of the present invention.

Figure 6:
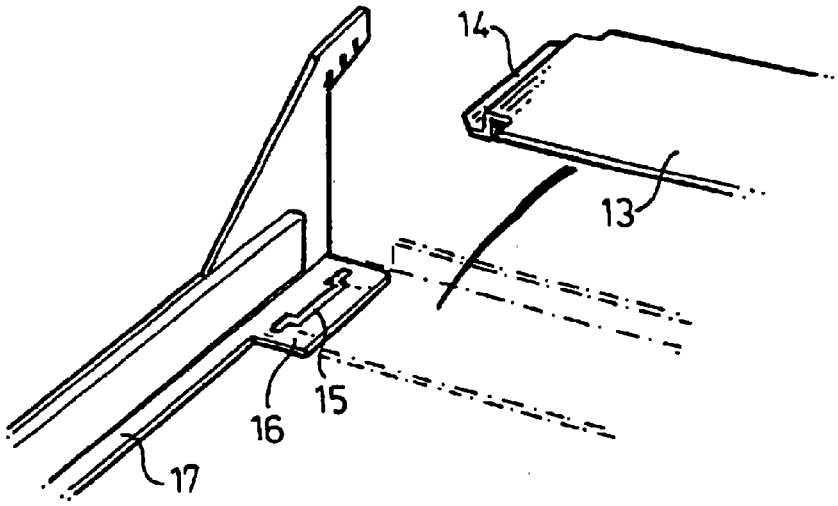
FIG. 6 illustrates how the shelf can be assembled at the point of use.

As can be seen from FIG. 2, the inner ends of the brackets 4 are connected by means of a transverse connecting element 13, suitably in the form of a plate with bent end portions 14, see FIG. 6. The plate 13 can then be connected to the two brackets 4 by virtue of the bent end portions 14 being inserted into a slot-shaped opening 15 in a part 16 projecting from each bracket 4. This connection can be made simply at the point of use without using any loose connecting elements or welding.

The embodiment described of the shelf allows the latter to be transported in a demounted state in a relatively thin pack and to be assembled into an operational shelf at the point of use. To this end, all that is necessary is for the brackets 4 to be connected by means of the connecting element 13 and the frame-shaped construction 8, 9, 10 to be fastened firmly to the pull-out rails 7 mounted on the brackets 4. This is a great advantage with regard to both transport and storage.

The shelf can be pulled out from the inner position shown in FIG. 1 into the outer position shown in FIG. 2 and locked both in these positions and steplessly in any desired position in between. For this purpose, the shelf comprises friction bodies, which work between the lower edge surface of each fixed rail 6 and, located below the latter, a flange 17 of the associated bracket 4. This is illustrated in greater detail in FIG. 3 and the part enlargements in FIGS. 4A and 4B.

Figure 3:
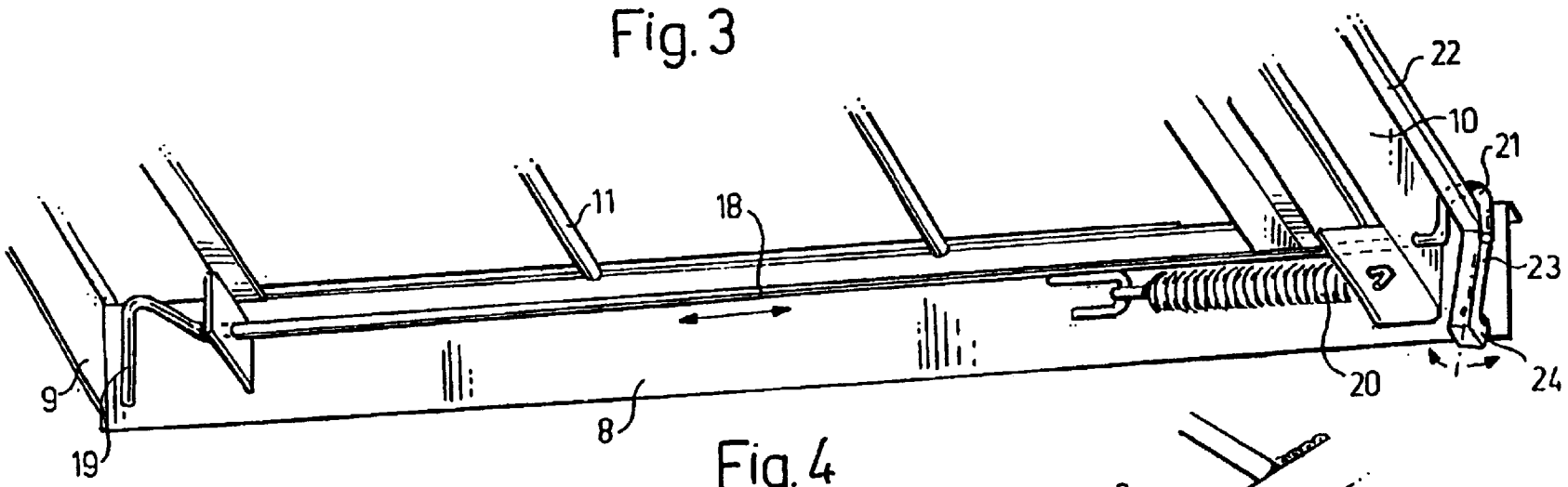
FIGS. 3 and 4, 4*a*, 4*b* illustrate the locking mechanism of the shelf in greater detail.

FIG. 3 shows one side of the shelf seen from below with a pull rod 18 running along the angle profile 8 and having a front operating handle 19. In the unactuated state, the pull rod 18 is held in a retracted position by means of a spring 20, one end of which is fastened to the pull rod and the other end of which is fastened to the rear transverse member 10. The rear end of the pull rod 18 is bent so as to form a U-shaped end portion 21 which engages over a transverse bar 22 which runs between the two angle profiles 8 of the shelf. Each end of the bar 22 is bent in the form of a crank 23 with a crank pin 24, which pins form the abovementioned friction bodies.

Figure 4:
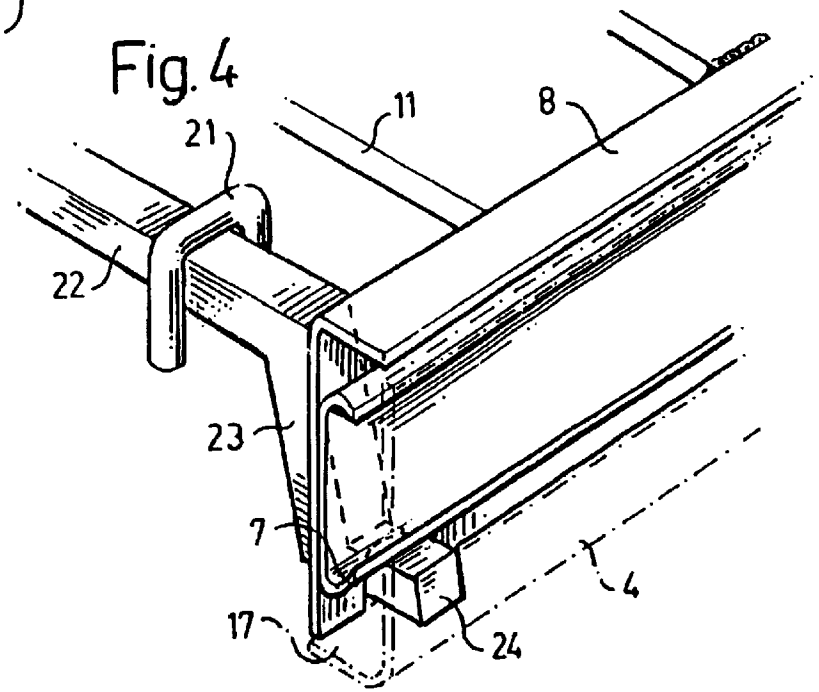
Figure 4B:
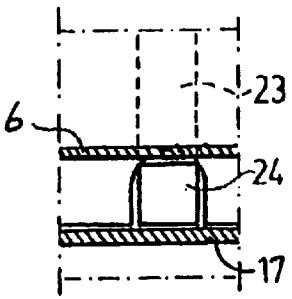
Figure 4A:
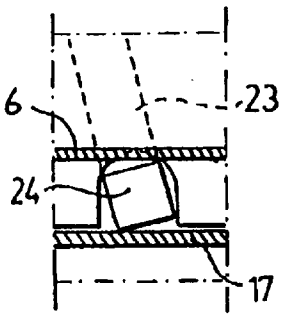

As can best be seen from FIG. 4, the crank pin 24 projects in through an opening in the associated profile element 8 and into a space formed above the lower flange 17 of the associated bracket 4 for interaction with the flange and the lower edge of the fixed rail 6, see FIGS. 4A and 4B.

The crank pin 24 has a non-circular, suitably square, cross section, and is rotated somewhat in relation to the remainder of the bar 22. In the rest position, that is to say when the operating handle 19 is not being actuated and the operating rod 18 is located in the retracted position by means of the spring 20, the crank pin 24 adopts the position shown in FIG. 4A. In this position, the pin bears against both the flange 17 of the bracket 4 and the lower edge of the fixed rail 6 (not shown in FIG. 4) arranged on the bracket and, by means of this engagement between two stationary surfaces, prevents a relative displacement between the rail and the bracket. This means that the shelf is held locked in this position. In particular, it is made impossible to pull the shelf out. A movement of the shelf in the direction of pulling-out tends to increase the engagement force between the corner edges of the crank pin and the flange 17 and, respectively, the rail 6. If desired, the friction engagement between the crank pin 24 and the flange 17 and, respectively, the rail 6 can be further improved by means of suitable coatings or other finishing of the interacting surfaces.

When the shelf is to be pulled out, the pull rod 18 is actuated via the operating handle 19, and the transverse bar 22 will then move toward the front edge of the shelf. Such a movement results in a certain rotation of the crank pin 24, so that the latter adopts the position shown in FIG. 4B. The friction engagement between the crank pin 24 and the flange 17 of the bracket 4 and, respectively, the fixed rail 6 is then freed, and the shelf can be pulled out into the desired position and locked in it by releasing the operating handle 19, the spring 20 then rotates the crank pin 24 back into the locking position shown in FIG. 4A.

This therefore makes it possible for the shelf to be locked in an entirely optional position without regard to positions of adjustment holes or adjustment notches. The shelf can then be used together with shelves of different depth and still be locked so that the front edges come into line with one another or so that the shelf projects forward a desired distance in front of a shelf lying above in order to bring about what is known as a cascade formation.

Furthermore, the instantaneous locking of the shelf in the position adopted on release of the operating handle 19 results in the elimination of the risk that personnel will be injured as a consequence of someone losing his grip on a shelf which is inclined forward and downward. The shelf would otherwise be able to come out with great force, in particular if it is heavily laden. With the construction according to the invention, however, the shelf will be locked instantaneously as soon as the operating handle 19 has been released.

Figure 5:
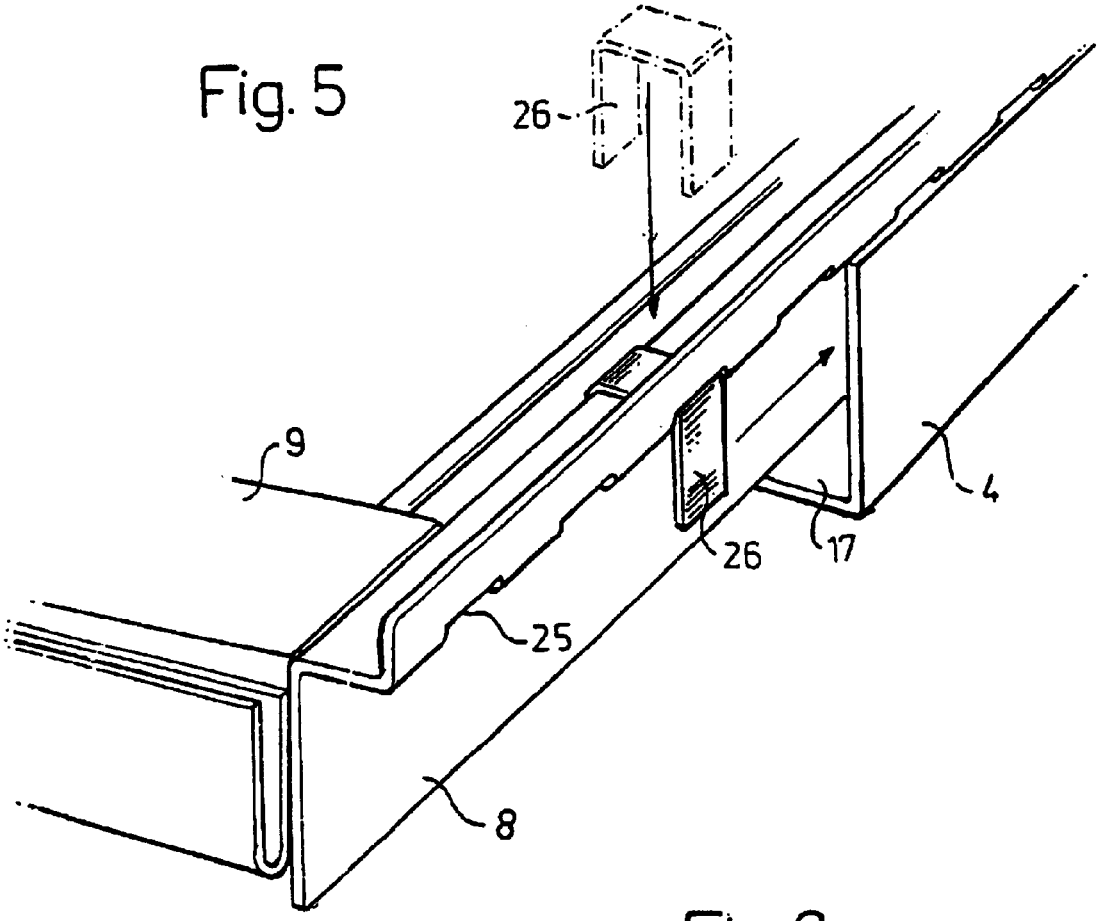
FIG. 5 illustrates how the inner position of the shelf can be preset.

FIG. 5 illustrates how the location of the pushed-in position of the shelf can be adjusted. To this end, the angle profiles 8 are made with a number of slot-shaped openings 25, in which a stirrup-shaped stop element 26, for example, can be mounted. A stop element 26 mounted in this manner will, when the shelf is pushed in, interact with the front edge surface of the bracket 4 or of the fixed rail 6 mounted thereon and prevent further pushing-in of the shelf.

This makes it possible for the shelf, after pulling out, always to be returned to the starting position by being pushed back into the stop position, where the operating handle is released, whereupon the shelf is locked in the position adopted. The stop position can therefore be adjusted by means of the stirrup-shaped stop elements without regard for any particular locking positions for the locking member, as the invention makes possible stepless locking of the shelf in the desired position.

Figure 7:
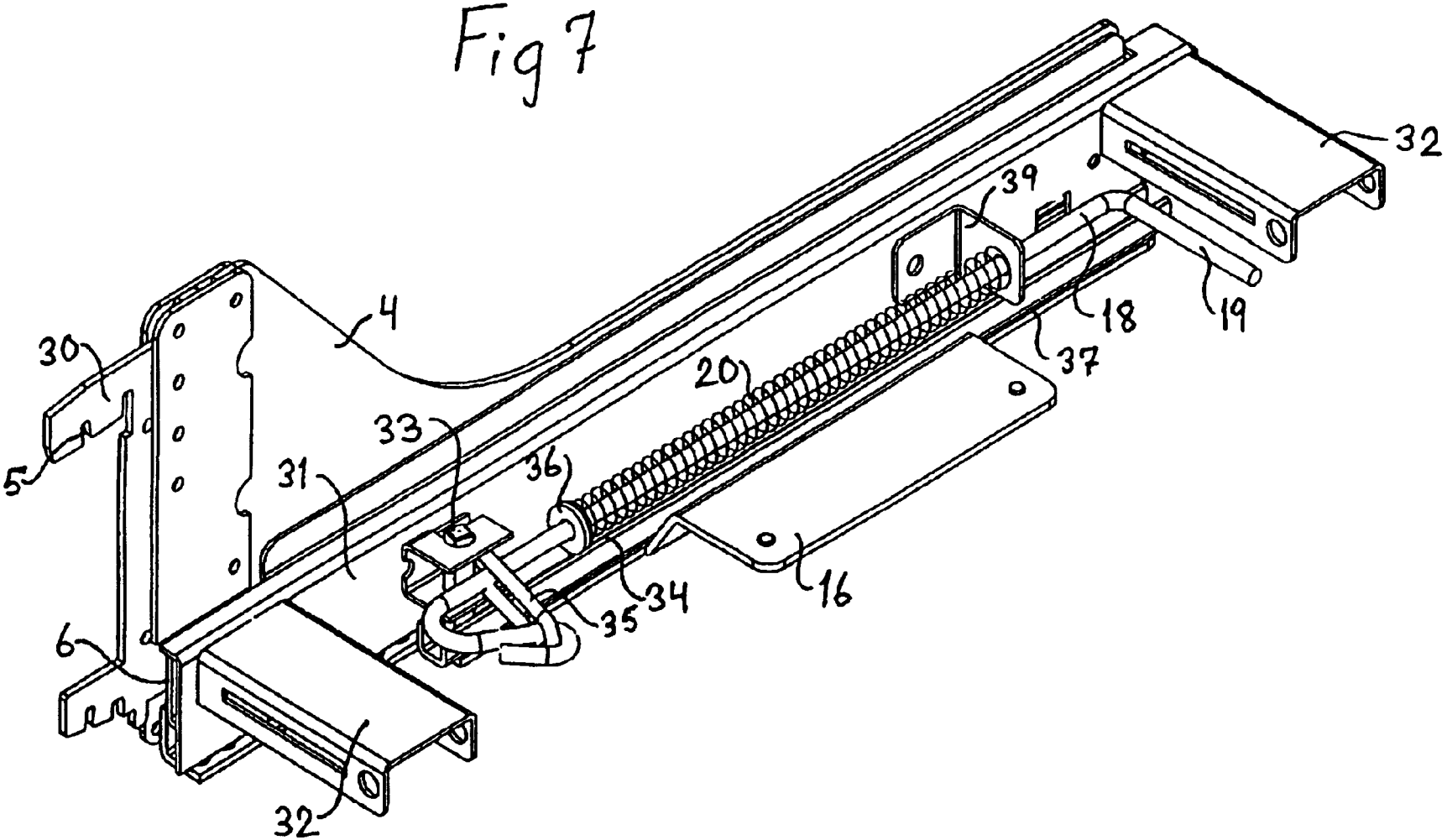
FIG. 7 shows a shelf bracket with a different, preferred embodiment of a locking mechanism for a shelf according to the invention.
Figure 8:
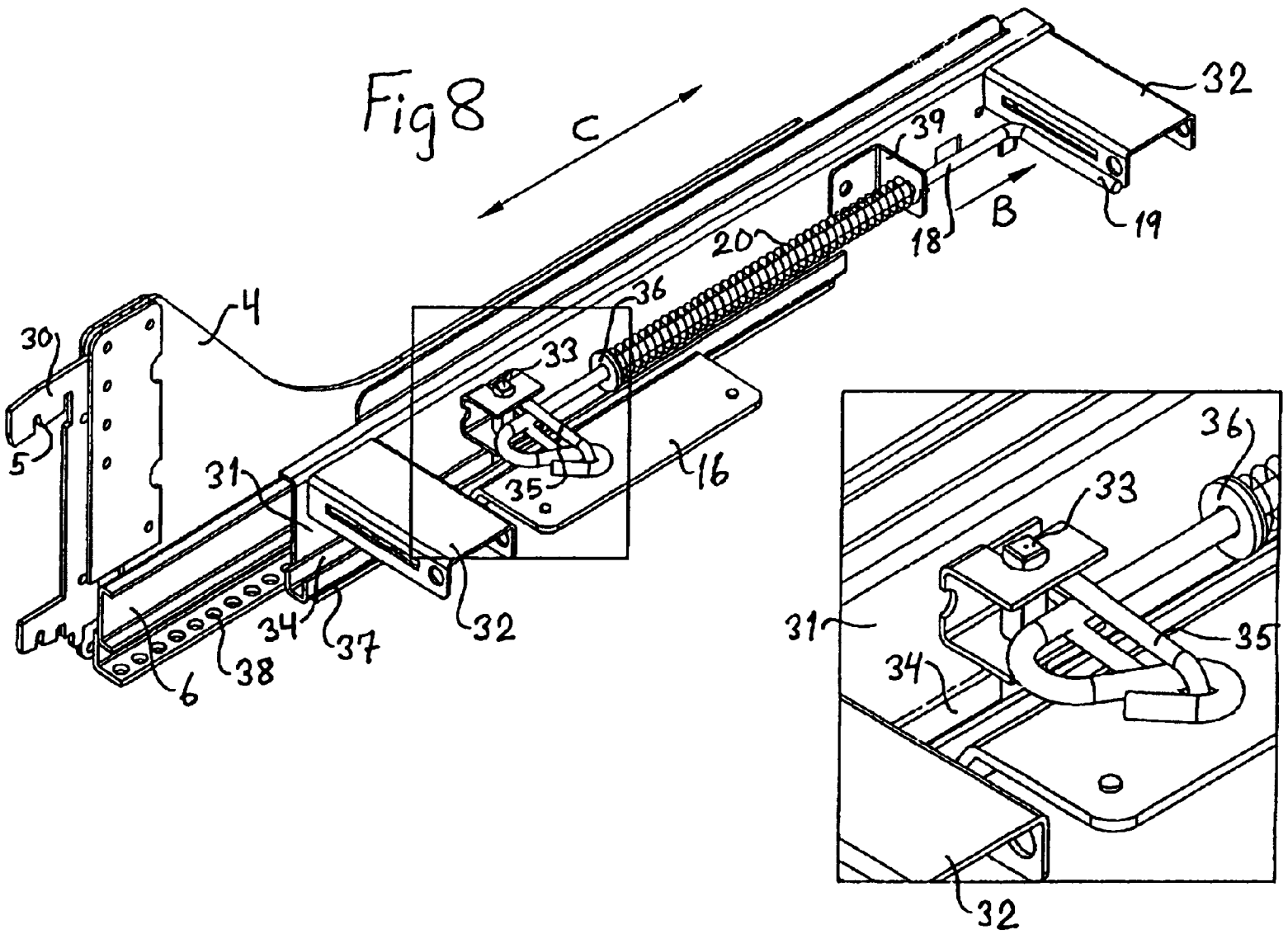
FIG. 8 shows the bracket according to FIG. 7 when a shelf is being pulled out.
Figure 9:
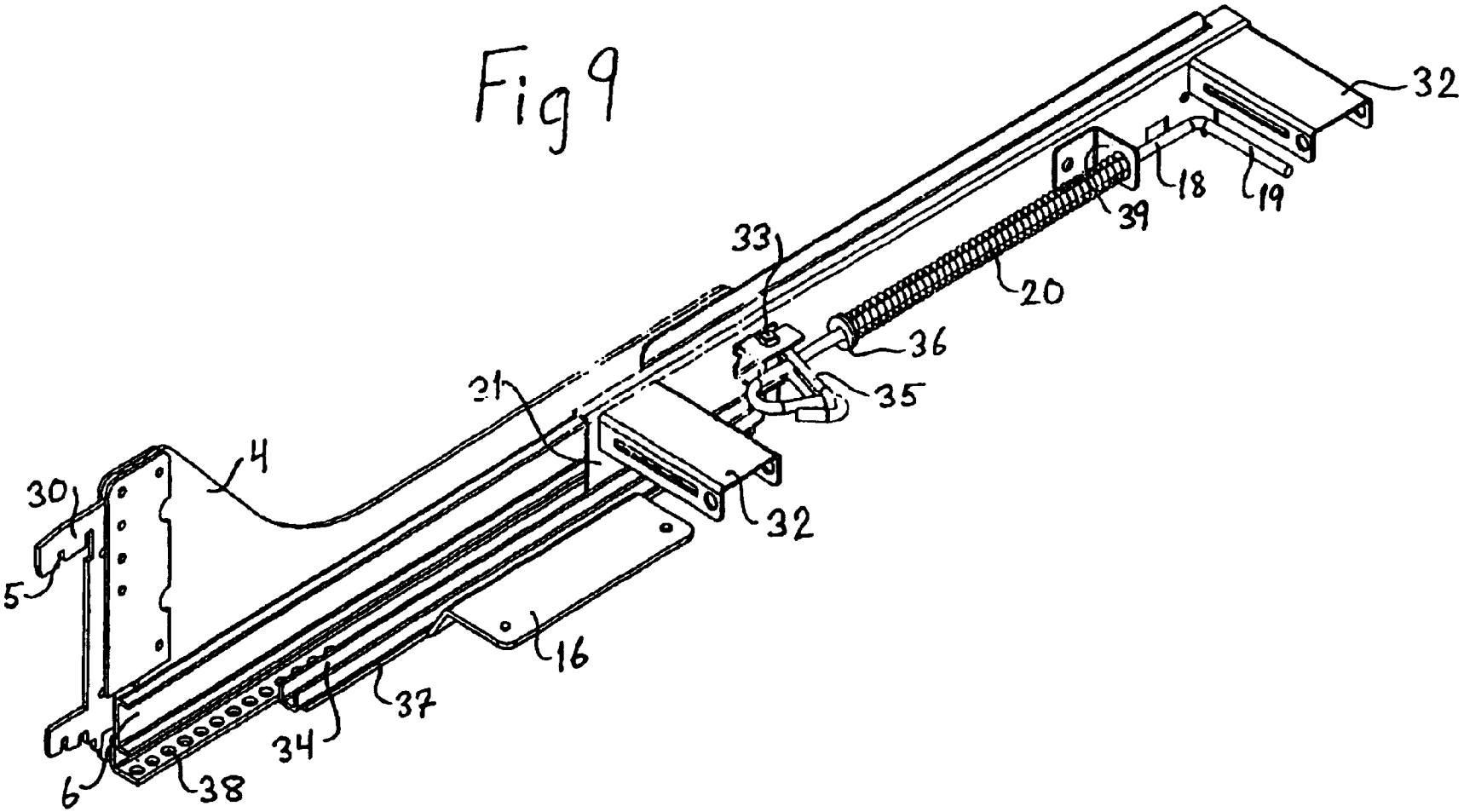
FIG. 9 shows the bracket according to FIG. 7 when the shelf is fully pulled out.

FIGS. 7–11 illustrate the construction and function of an alternative, preferred embodiment of a locking mechanism for a pull-out shelf according to the invention. Components which have counterparts in figures described previously have been given the same reference numbers as in these figures. FIGS. 7–9 show only one bracket 4 of the shelf, with the associated braking mechanism. A corresponding mechanism is suitably also mounted on the other bracket of the shelf. The bracket 4 is provided with an exchangeable adapter 30 so as to be capable of being mounted on uprights with a different hole spacing. The adapter 30 can also be mounted at different heights on the bracket 4 so as to allow fine adjustment of the distance between shelves located one above another.

Mounted on the bracket 4 is a fixed rail 6. A pull-out rail, on which one end wall 31 of the shelf is mounted, runs in the rail 6. The opposite end walls of the shelf are connected to cross-members which are mounted in mountings 32 on each end wall. The desired type of shelf plane can then be arranged on the cross-members. The brackets are also provided with mounting parts 16 for connecting elements which can be mounted simply at the point of use.

As previously, each locking mechanism comprises a rotatable friction body 33 of rectangular, preferably square, cross section. In this case, the friction body 33 projects down into a U-shaped rail 34, the legs of which form two opposite engagement surfaces for interaction with the friction body 33.

The friction body 33 is connected rigidly to a stirrup-shaped link 35 which is an coupled to one, bent, end of a pull rod 18 with an operating handle 19. In the unactuated state, the pull rod 18 is brought back into a locking position by means of a compression spring 20 which acts between a fixed washer 36 on the pull rod and a bracket 39. The U-shaped rail 34 is fixed in relation to the bracket 4 and is mounted on a lower flange 37 projecting from the bracket. An inner part of the flange 37 is provided with adjustment holes 38 for receiving a stop member (not shown) which defines the inner end position of the shelf.

Figure 10:
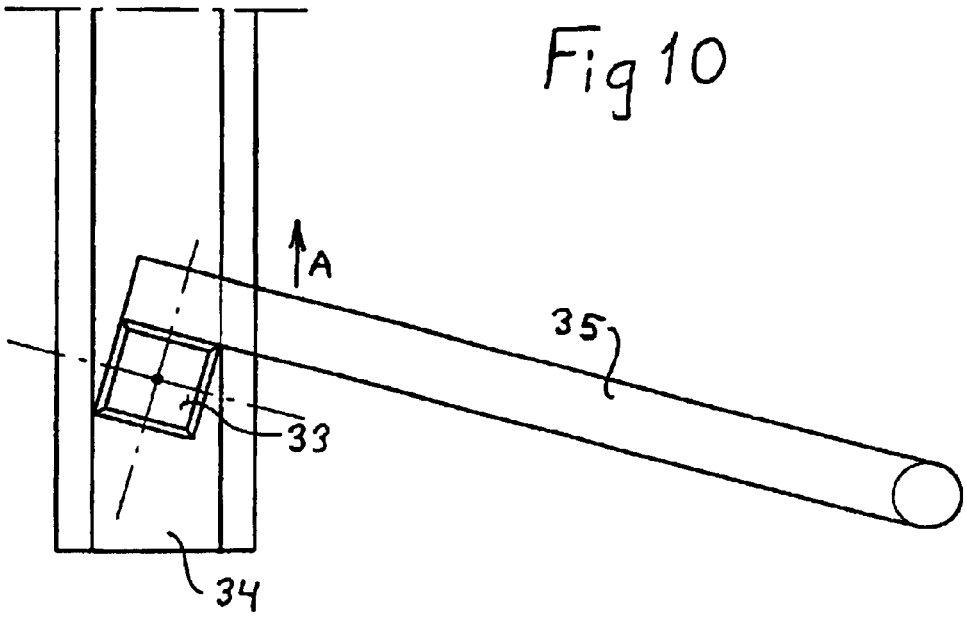

FIG. 7 shows the shelf end wall 31 in a pushed-in, locked position, that is to say the spring 20 exerts a backwardly directed pressing force on the pull rod 18, so that the friction body 33 is held in the rotational position illustrated in FIG. 10 relative to the side surfaces of the U-shaped rail 34. A tensile force acting on the friction body 33 in the direction of the arrow A tends to increase further the friction engagement between the friction body and the opposite engagement surfaces.

Figure 11:
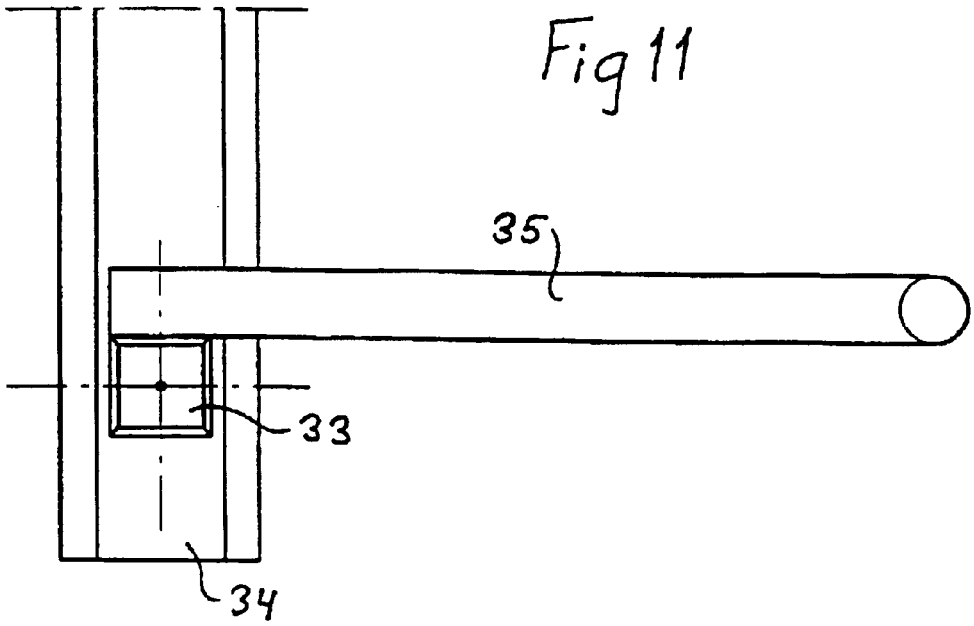
FIGS. 10 and 11 illustrate the rotational position of the locking body in the locking position and, respectively, the free position.

In FIG. 8, the pull rod 18 has been actuated in the direction of the arrow B, which has resulted in the friction body 33 having been rotated into the position shown in FIG. 11. The shelf end wall 31 is then free to move to and fro, as illustrated by means of the arrow C in FIG. 8.

FIG. 9 illustrates the shelf end wall in an outer end position with the pull rod 18 released, the spring 20 again having brought about a rotation of the friction body 33 into the locking position illustrated in FIG. 10. Such locking can also be brought about in any other desired position between the inner and outer end positions of the shelf end wall.

The locking mechanism described is very simple and robust in its construction and affords great reliability. In the embodiment shown in the drawings, the friction body 33 is oriented vertically and projects down into a rail 34 lying below. Alternatively, the friction body can also be oriented horizontally, for example, and project into a rail arranged on the side surface of the bracket. In the case of a vertically oriented friction body, the rail can also be mounted above the pin and interact with the upper end of the latter. The compression spring 20 can be replaced by a tension spring acting in the other direction, The invention has been described above in connection with the embodiments shown in the drawings. However, these can be varied in a number of respects within the scope of the patent claims. Although the embodiment shown in FIG. 1 uses two symmetrically arranged locking mechanisms, it may be sufficient for some applications to make use of a single locking mechanism or an operating member which actuates a separate locking element according to FIG. 7 on each side. The locking body shown is of square cross section. However, it can be replaced by another, non-circular cross section which performs the same function. Instead of subjecting the transverse locking bar in FIG. 3 to a tensile force, essentially the same function can be achieved by applying a displacing force to it, the rotation of the crank pins then taking place in the opposite direction.

What is claimed is:

1. A pull-out shelf for mounting on rack uprights (1), comprising:

two brackets (4) projecting from the uprights or from supports mounted thereon, at least one rail (7) mounted on each bracket so as to be capable of being pulled out, and a shelf plane (8–12), supported by the rails, for articles which are to be placed on the shelf, said shelf comprising at least one releasable locking member which, when an associated operating member (18) is actuated manually, releases the rails (7), so that the rails can be pulled out and pushed in, and, in the unactuated state, locks the rails relative to the brackets (4), wherein, when the operating member is unactuated, said locking member locks the rails under the action of a spring force, in that said manual actuation of the operating member occurs counter to the action of said spring force, so that releasing said operating member results in instantaneous locking of the rails and thus the shelf in the current position so as to allow locking of the shelf in any position between an inner and an outer end position, wherein said locking member follows the movements of the shelf and comprises a friction body (24) projecting between engagement surfaces of one of said two brackets (4) of the shelf, wherein the friction body (24) has a non-circular cross section, and said operating member (18) is adapted so as, when actuated, to bring about a rotation of the friction body from a locking position, in which the friction body is in friction engagement with said engagement surfaces, into a free position, in which it can be displaced relative to said engagement surfaces.

2. The shelf as claimed in claim 1, further comprising two locking members, and a rotatable friction body (24) being arranged between said engagement surfaces of each of said two brackets (4).

3. The shelf as claimed in claim 1, wherein said friction body has a rectangular cross section, and, in the locking position, said friction body is rotated in such a manner relative to the engagement surfaces that the engagement with said engagement surfaces increases as a consequence of an outwardly directed tensile force acting on the shelf.

4. The shelf as claimed in claim 1, characterized in that the operating member intended for rotating said friction body consists of a spring-loaded operating rod arranged on the shelf, which rod, in the unactuated state, holds the friction body in a locking position under the action of the spring force and, when actuated counter to the action of the spring force, rotates the friction body into a free position.

5. The shelf as claimed in claim 1, wherein said engagement surfaces are formed by the legs of said at least one rail with a U-shaped profile arranged on at least one of said two brackets of the shelf.

6. The shelf as claimed in claim 5, characterized in that the U-shaped rail is borne by a lower horizontal flange of the bracket.

7. The shelf as claimed in claim 1, wherein said engagement surfaces are formed by a lower horizontal flange of at least one bracket of the shelf and by a lower edge of a fixed guide rail which is borne by the bracket and in which the pull-out rail of the shelf runs.

8. A pull-out shelf for mounting on rack uprights (1) comprising:

two brackets (4) projecting from the uprights or from supports mounted thereon, at least one rail (7) mounted on each bracket so as to be capable of being pulled out, a shelf plane (8–12), supported by the rails, for articles which are to be placed on the shelf, said shelf comprising two releasable locking member which, when an associated operating member (18) is actuated manually, releases the rails (7), so that the rails can be pulled out and pushed in, and, in the unactuated state, locks the rails relative to the brackets (4), wherein, when the operating member is unactuated, said locking members lock the rails under the action of a spring force, in that said manual actuation of the operating member occurs counter to the action of said spring force, so that releasing said operating member results in instantaneous locking of the rails and thus the shelf in the current position so as to allow locking of the shelf in any position between an inner and an outer end position, and a rotatable friction body (24) arranged between engagement surfaces of each of said brackets (4), wherein said friction bodies (24) consist of the end portion of a bar (22) extending between the brackets (4), in that the bar follows the displacement movements of the shelf, and in that the bar can by rotated by means of said operating member (18).

9. The shelf as claimed in claim 1, further comprising adjustable stop members (26) which are adapted so as to allow adjustment of the location of the inner position of the shelf.

10. A pull-out shelf for mounting on rack uprights (1), comprising:

two brackets (4) projecting from the uprights or from supports mounted thereon, at least one rail (7) mounted on each bracket so as to be capable of being pulled out, a shelf plane (8–12), supported by the rails, for articles which are to be placed on the shelf, said shelf comprising at least one releasable locking member which, when an associated operating member (18) is actuated manually, releases the rails (7), so that the rails can be pulled out and pushed in, and, in the unactuated state, locks the rails relative to the brackets (4), wherein, when the operating member is unactuated, said locking member locks the rails under the action of a spring force, in that said manual actuation of the operating member occurs counter to the action of said spring force, so that releasing said operating member results in instantaneous locking of the rails and thus the shelf in the current position so as to allow locking of the shelf in any position between an inner and an outer end position, and adjustable stop members (26) which are adapted so as to allow adjustment of the location of the inner position of the shelf, wherein said stop members (26) comprise stirrups, pins or equivalent, which can be mounted in any of a number of holes (25) or slots, so that they delimit the pushing-in of the pull-out rail (7) relative to the bracket (4).

11. The shelf as claimed in claim 1, characterized in that the brackets (4) are interconnected by means of at least one transverse stay (13) which is easy to mounted and allows to be assembled at the point of use.

12. The shelf as claimed in claim 1, wherein parts (3) of the brackets (4) which interact with slot-shaped holes in the rack uprights (1) are made with adjustment notches (5) so as to allow the shelf to be mounted at different angles relative to the rack uprights (1).

* * * * *